United States Patent [19]

Fencl et al.

[11] 4,316,377

[45] Feb. 23, 1982

[54] ROLL FORGING MACHINE

[75] Inventors: Vernon R. Fencl, Northbrook; Laszlo Javorik, Oregon, both of Ill.

[73] Assignee: Grotnes Metalforming Systems, Inc., Chicago, Ill.

[21] Appl. No.: 96,818

[22] Filed: Nov. 23, 1979

[51] Int. Cl.[3] ..... B21B 1/42

[52] U.S. Cl. ..... 72/189

[58] Field of Search ..... 72/187, 189, 212, 242; 29/156.8 R

[56] References Cited

U.S. PATENT DOCUMENTS

| | | | |
|---|---|---|---|
| 1,903,724 | 4/1933 | Rohn | 72/242 |
| 2,736,948 | 3/1956 | Barnes | 72/187 |
| 3,229,494 | 1/1966 | Paille et al. | 72/189 X |
| 3,357,223 | 12/1967 | Tremblay | 72/189 |
| 3,415,094 | 12/1968 | Stikeleather et al. | 72/187 |
| 3,690,138 | 9/1972 | Weber | 72/189 |
| 3,995,780 | 12/1976 | German | 72/187 |

*Primary Examiner*—James G. Smith

*Attorney, Agent, or Firm*—Leydig, Voit, Osann, Mayer & Holt, Ltd.

[57] ABSTRACT

A roll forging machine has a pair of opposed work rolls carrying cooperating dies and a pair of support rails mounted on each work roll on opposite sides of the die thereon. The support rails provide the work rolls with a high spring constant, so that the supporting framework can have a relatively low spring constant. During forging the work rolls are urged together with a force substantially greater than the force required to forge the workpiece, and the opposed support rails are pressed together to prestress the work rolls. The dies and support rails occupy only preselected segments of the circumferences of the work rolls, and a pair of backup rolls bear against each work roll on the balance of the circumference. The two backup rolls for each work roll are positioned asymmetrically with respect to the plane of the workpiece, with the backup roll on the feed side of the work roll being located farther away from the plane of the workpiece than is the other backup roll. One hydraulic cylinder urges the two work rolls together, and a second hydraulic cylinder urges the workpiece into the work rolls, with a constant ratio being maintained between the pressures applied by the two hydraulic cylinders.

11 Claims, 16 Drawing Figures

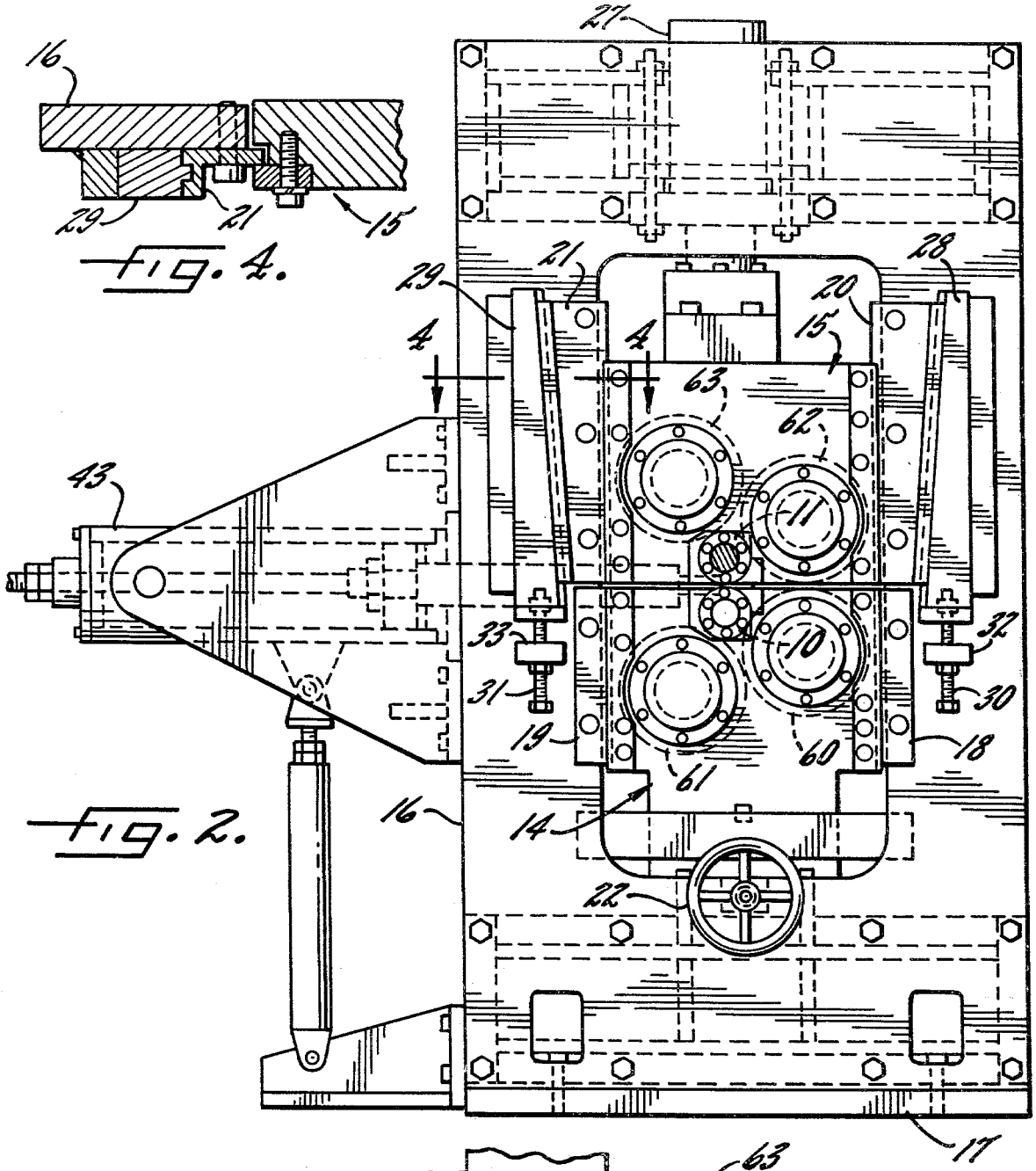
Fig. 4.
Fig. 2.
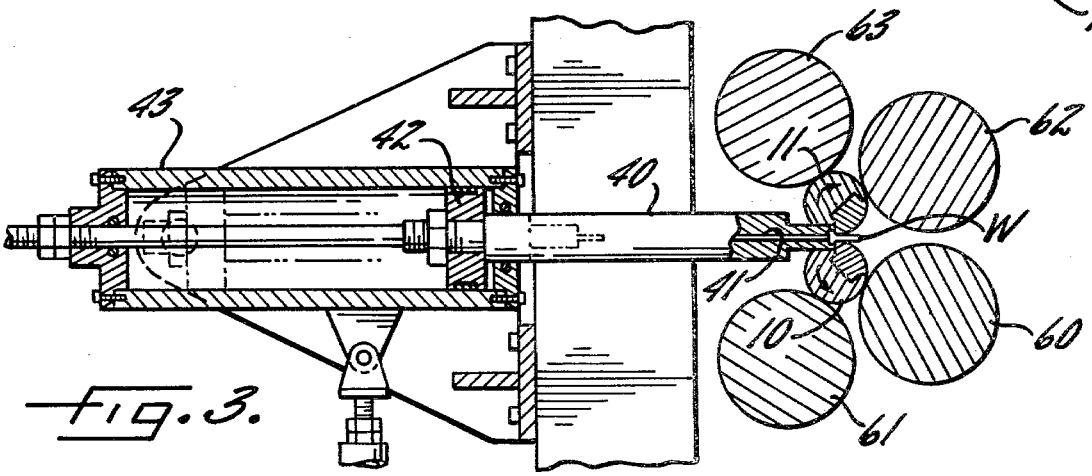
Fig. 3.

ROLL FORGING MACHINE

DESCRIPTION OF THE INVENTION

The present invention relates generally to roll forging systems and, more particularly, to systems which are suitable for the roll forging of articles such as turbine blades which vary in thickness and profile along the length thereof. This invention is particularly concerned with roll forging systems in which the roll forging of each article is effected by substantially less than one revolution of the work roll.

It is a primary object of the present invention to provide a roll forging system which is capable of accurately and reliably producing articles with a high degree of accuracy in the final dimensions in spite of relatively large changes in thickness and shape along the lengths of the articles, while minimizing the stiffness requirements for the main frame which carries the work roll. In this connection, a related object of the invention is to minimize the cost of the machine for any given degree of accuracy required in the thickness of the forged products.

It is another object of this invention to provide an improved roll forging system of the foregoing type which is also capable of coining selected regions of the workpiece.

A further object of this invention is to provide an improved roll forging system which is capable of producing large numbers of relatively complex articles with a high degree of uniformity and accuracy.

Still another object of this invention is to provide such an improved roll forging system in which the forging dies are readily accessible for servicing and replacement.

Other objects and advantages of the invention will be apparent from the following detailed description and the accompanying drawings, in which:

FIG. 2 is a side elevation, partially in section, taken generally along line 2—2 in FIG. 1;

FIG. 3 is a section taken generally along line 3—3 in FIG. 1;

FIG. 4 is an enlarged fragmentary section taken generally along line 4—4 in FIG. 2;

While the invention has been shown and will be described in some detail with reference to an exemplary embodiment of the invention, there is no intention that the invention be limited to such detail. On the contrary, it is intended to cover all modifications, alternatives and equivalents which fall within the spirit and scope of the invention as defined by the appended claims.

Figure 1:
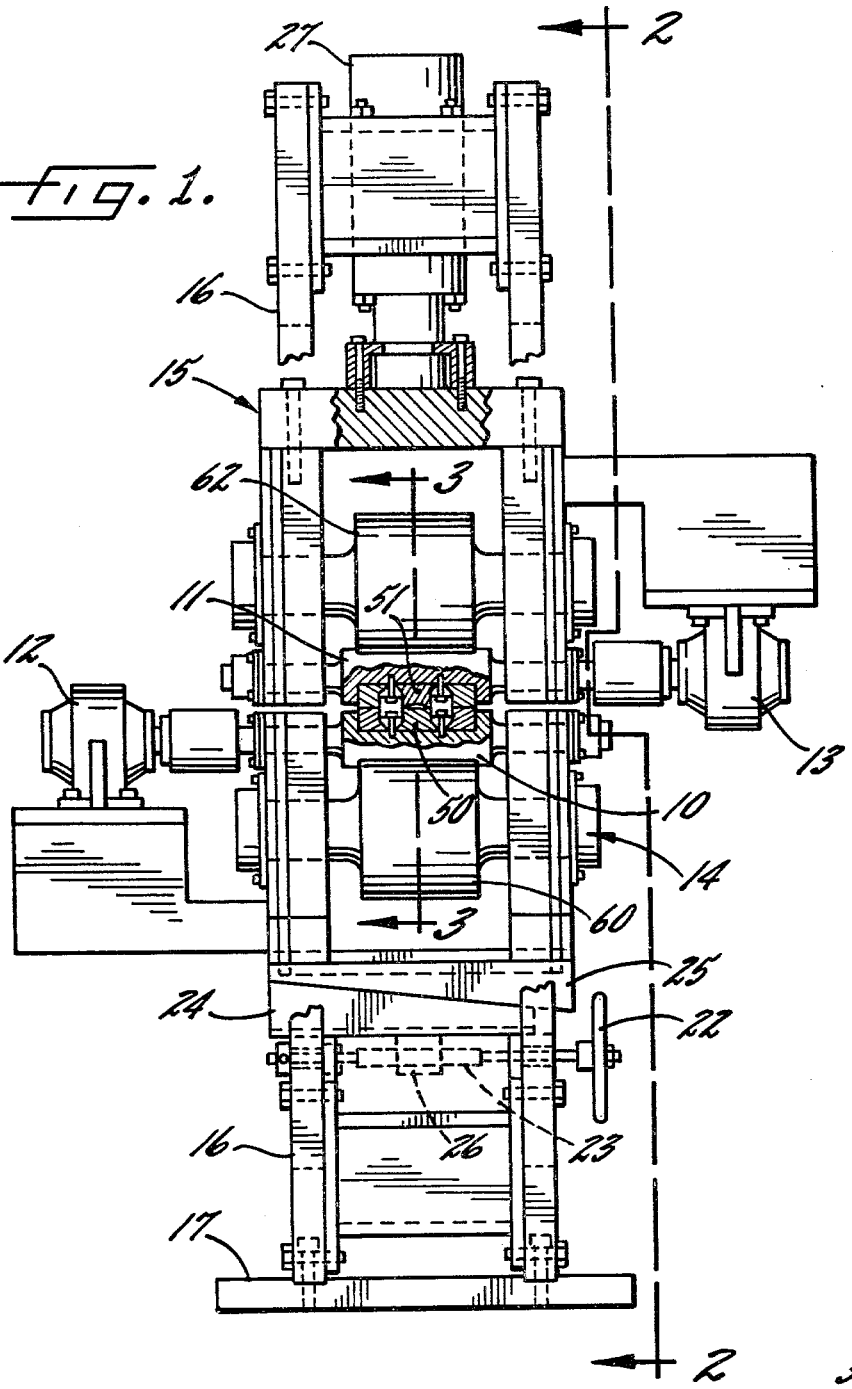
FIG. 1 is an end elevation, partially in section, of a roll forging machine embodying the invention.

Turning now to the drawings and referring first to FIGS. 1 and 2, there is shown a roll forging machine having a pair of work rolls 10 and 11 driven by a pair of vane-type hydraulic rotary actuators 12 and 13, respectively. The two work rolls 10 and 11 are carried by two independently adjustable units 14 and 15, both of which are slidably mounted on a main frame 16 extending upwardly from a base 17. More specifically, the bottom unit 14 carrying the work roll 10 is mounted for sliding movement in two pairs of vertical slides 18, 19 (FIG. 2), and the top unit 15 is similarly mounted in two pairs of vertical slides 20, 21. Vertical adjustment of the bottom unit 14 is effected by turning a hand wheel 22 which turns a screw 23 to horizontally move a ramp 24 bearing against a complementary ramp 25 on the bottom of the unit 14. The ramp 24 is attached to a nut 26 threaded onto the screw 23 so that rotation of the screw 23 via the hand wheel 22 moves the ramp 24 horizontally along a path which is parallel to the axis of the screw 23. The camming action of the two complementary ramps 24 and 25 adjusts the vertical position of the unit 14 in response to the turning of the screw 23 by the hand wheel 22. It will be appreciated that this limited vertical adjustment of the unit 14 is used only during initial setup, and then occasionally thereafter to compensate for normal wear.

The upper unit 15, on the other hand, is traversed up and down along its vertical slides 18, 19 for each new workpiece that enters the machine. This vertical movement of the unit 15 is effected by a hydraulic cylinder 27 mounted on the top of the main frame 16, within its piston rod secured to the top of the unit 15. The top unit 15 can also be manually adjusted in the horizontal direction, normal to the axis of the work rolls 10 and 11, by means of a pair of movable ramps 28 and 29 (FIG. 2) supported on a pair of depending screws 30 and 31 threaded through a pair of flanges 32 and 33 welded to the main frame 16. As can be seen most clearly in FIG. 4, the ramps 28 and 29 ride on a pair of complementary ramps formed as a part of the slides 20 and 21, so that vertical movement of the ramps 28 and 29 shifts the horizontal positions of the slides 20 and 21. Here again, this manual adjustment of the horizontal position of the top unit 15 is normally utilized only during initial setup and then occasionally thereafter to compensate for wear or the like.

Figure 5:
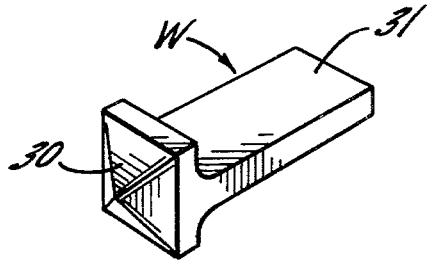
FIG. 5 is a perspective view of a typical workpiece, prior to being worked, for use in forming a turbine blade in the machine of FIGS. 1-4.
Figure 6:
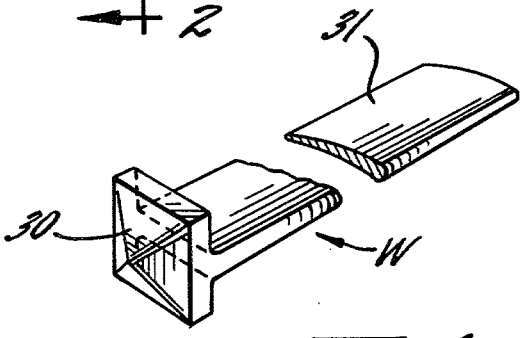
FIG. 6 is a perspective view of the workpiece shown in FIG. 5 after it has been worked in the machine of FIGS. 1-4 form a turbine blade.

A typical workpiece W for forming a turbine blade is illustrated in FIG. 5 (before forging) and FIG. 6 (after forging). The head 30 of the workpiece W is unchanged by the working thereof, except for that portion of the head 30 which merges with the base of the blade portion 31; this corner region is coined before the blade portion 31 of the workpiece is rolled, so as to reduce the radius of curvature of this corner region while at the same time reducing the thickness of the base of the blade portion.

The workpiece W is fed into the forging machine while the upper unit 15 is in its raised position to open a gap between the two work rolls 10 and 11. As shown most clearly in FIG. 3, the workpiece W is carried on the end of a holder 40 and held thereon by means of a vacuum drawn through a central bore 41. The holder 40 in turn is secured to a piston 42 within a hydraulic cylinder 43. This hydraulic cylinder 43 serves not only to feed and retract the workpiece W, but also to apply horizontal pressure to the workpiece W during coining of that portion of the workpiece W which forms the base of the turbine blade, as will be described in more detail below. The vertical force for the coining operation is applied by the hydraulic cylinder 27, which also applies the force which forges the blade portion of the workpiece during subsequent turning of the work rolls 10 and 11 by the hydraulic actuators 12 and 13.

The precise shape of the forged portion of the workpiece is determined by a pair of forging dies 50 and 51 carried by the respective work rolls 10 and 11. Although the forging dies 50 and 51 may be provided with any desired configuration, depending on the nature of the workpiece being forged, the particular dies shown in the illustrated embodiment are designed to form the desired cross-sectional configuration of a typical turbine blade, which has basically the contour of a aerodynamic wing profile.

In accordance with one important aspect of the present invention, two pairs of support rails are mounted on the work rolls on opposite sides of the dies thereon to provide the work rolls with a spring constant substantially greater than the spring constant of the supporting frame. These support rails engage each other and prestress the work rolls when the dies 50 and 51 are urged against the workpiece W. Thus, in the illustrative embodiment shown in FIGS. 7–10, a pair of support rails 52, 53 are mounted on the work roll 10 on opposite sides of the die 50, and a similar pair of support rails 54, 55 are mounted on opposite sides of the die 51 on the support roll 11. The two support rails on each roll are aligned with each other and with the die on that roll in the longitudinal direction along the surface of the roll. As can be seen most clearly in FIGS. 1 and 7, the two pairs of opposed support rails 52, 54 and 53, 55 ride on each other when the upper unit 14 has been lowered to bring the die 51 into engagement with the workpiece W, and these support rails remain in engagement with each other throughout the roll forging operation effected by rotation of the work rolls 10 and 11.

Location of the support rails 52, 53 and 54, 55 on opposite sides of the respective dies 50 and 51 provides a stiff support for the dies directly on the work rolls 10 and 11, thereby increasing the spring constants of the work rolls and reducing the stiffness requirements on the outside framework which supports the work rolls. It will be noted that the two pairs of support rails 52, 54 and 53, 55 are brought into engagement with each other as soon as the first increment of the workpiece blade is reduced to the desired cross section. Consequently, the load applied to the work rolls 10 and 11 by the vertical cylinder 27 is applied not just in the narrow central region where the dies 50 and 51 engage the workpiece, but across the entire length occupied by the support rails 52–55 as well as the dies 50 and 51. This vertical force applied to the work rolls by the cylinder 27 is substantially greater than the force required to forge the workpiece.

As a result of this arrangement, the work rolls 10 and 11 are prestressed, the spring constant of the work rolls becomes very high, and the spring constant of the supporting framework becomes relatively unimportant. That is, even though the separating forces applied to the work rolls by the workpiece W vary with the thickness of the workpiece, these variations represent only a small fraction of the total load on the work rolls, and thus any change in the deflection of the framework is insignificant. Even if the supporting framework is deflected because of its relatively low spring constant, there will be little or no deflection of the dies 50 and 51 relative to each other because of the relatively high spring constants of the work rolls 10 and 11. Stated in more technical terms, the Hertzian compression of the two pairs of support rails 52, 54 and 53, 55 is primarily responsible for any deflection of the dies 50 and 51 due to the separating forces exerted thereon by the workpiece. Consequently, the stiffness requirements for the supporting framework, and therefore the cost of the machine, can be minimized for any given degree of accuracy required in the thickness of the forged product.

Figure 7:
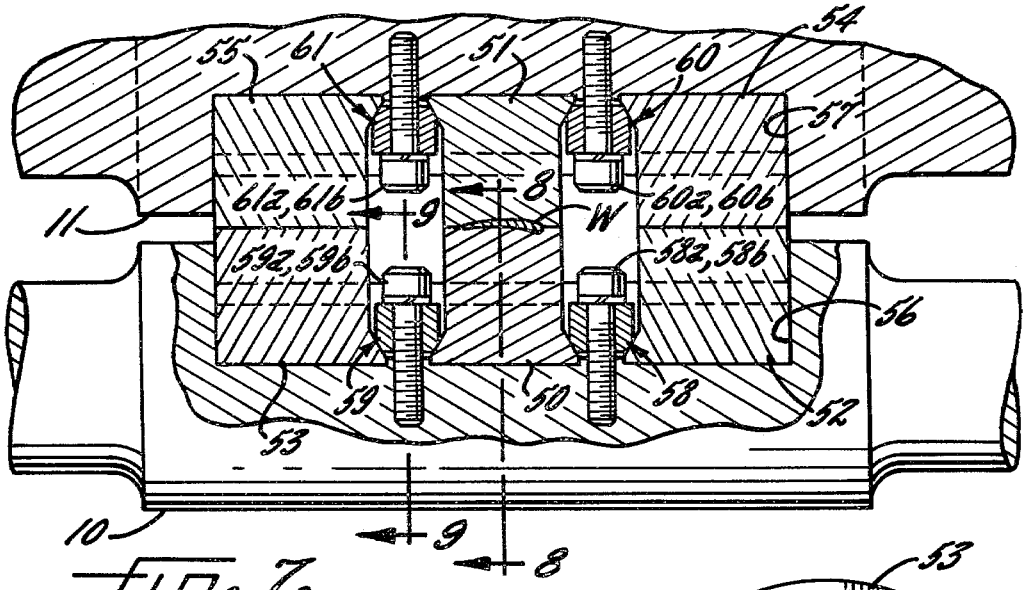
FIG. 7 is an enlarged side elevation, partially in section, of the work rolls in the machine of FIGS. 1-4.
Figure 8:
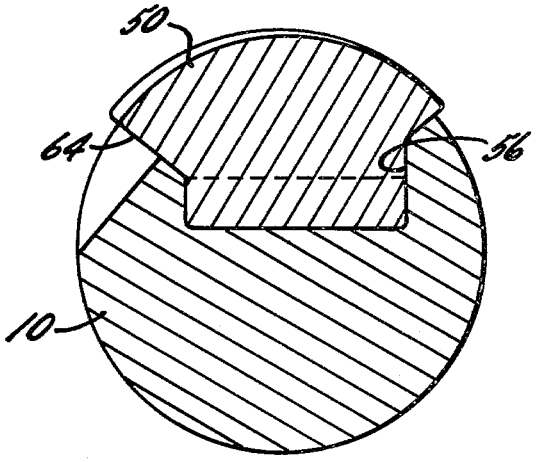
FIG. 8 is an enlarged section taken generally along line 8—8 in FIG. 7.
Figure 9:
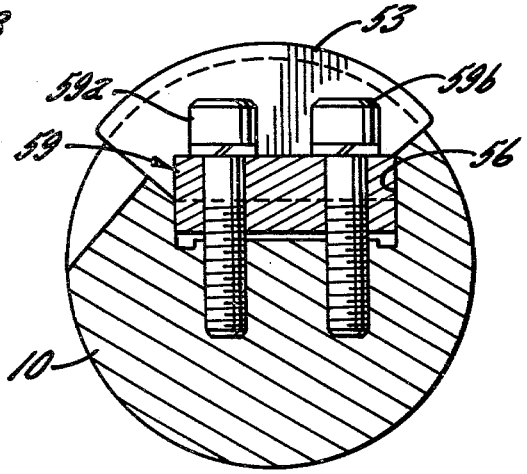
FIG. 9 is an enlarged section taken generally along line 9—9 in FIG. 7.
Figure 10:
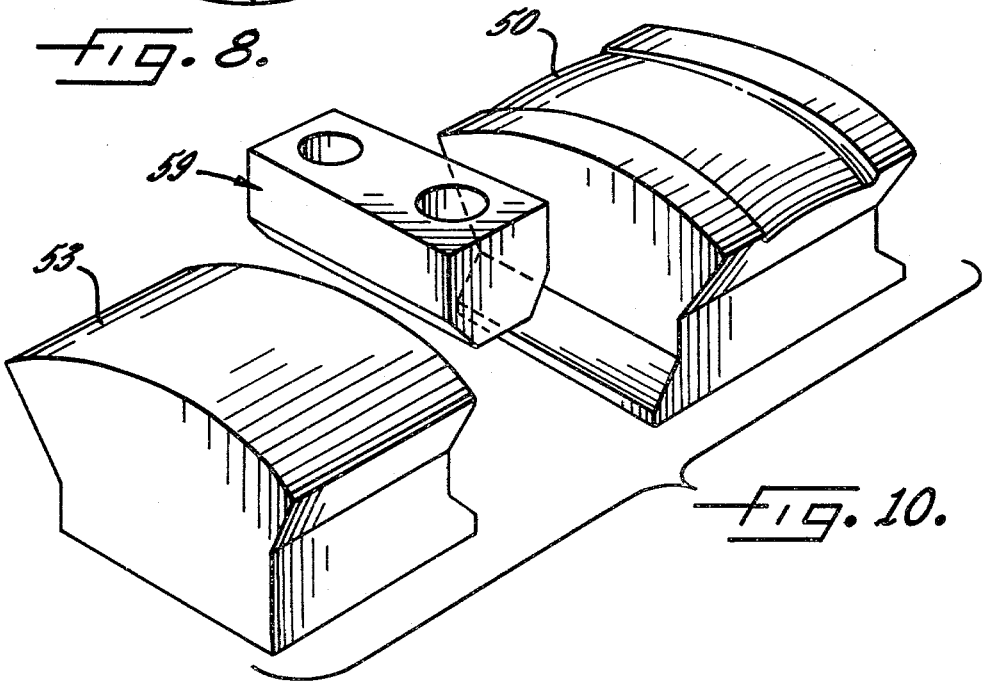
FIG. 10 is an enlarged perspective view of one of the dies and one of the support rails mounted on the bottom work roll of FIGS. 7-9.

As can be seen most clearly in FIGS. 7 and 9, the dies 50, 51 and the two sets of support rails 52, 53 and 54, 55 are mounted in recesses 56 and 57 formed in the respective work rolls 10 and 11. To avoid the need to form any holes in the dies and support rails, these elements are all clamped in their respective recesses by two pairs of clamping bars 58, 59 and 60, 61, each of which is securely fastened to the corresponding work roll by means of a pair of screws such as the screws **58*a* and 58*b* shown in FIG. 9. As can be seen in FIG. 7, the bottom corners of the clamping bars 58–61 are tapered inwardly at angles that are complementary to beveled shoulders formed at the bottom of the adjacent surfaces of the dies 50–51 and the support rails 52–55. Thus, the clamping bars wedge the forging dies and the support rails rigidly into fixed positions within the recesses 56 and 57 in the work rolls 10 and 11**.

In accordance with a further feature of the invention, the forging dies and support rails occupy only preselected segments of the circumferences of the work rolls, and a pair of backup rolls, substantially larger in diameter than the work rolls, bear against the work rolls on those portions of the circumferences not occupied by the dies and support rails. The backup rolls lend further stiffness and rigidity to the work rolls to resist deflection under the loads imposed on the work rolls during the coining and forging operations. Thus, in the illustrative embodiment, the forging dies 50 and 51 occupy only a relatively small segment of the total circumference of the work rolls 10 and 11. More particularly, the dies 50 and 51 occupy only about a 100° segment of the circumference of the work rolls, and thus the rolls need be turned through an angle of only 100° or less to effect the roll forging of the turbine blade. Backup rolls 60 and 61 support the lower work roll 10, and backup rolls 62 and 63 support the upper work roll 11. As will be described in more detail below, these two pairs of backup rolls 60, 61 and 62, 63 are strategically located to provide firm backup support for the work rolls during both the coining and forging operation. The bottom work roll 10 and its backup rolls 61, 62 are all mounted in common side plates of the bottom unit 14 so that all three rolls have a common integral support, and the same is true of the work roll 11 and its backing rolls 63, 64 in the top unit 15.

Figure 11:
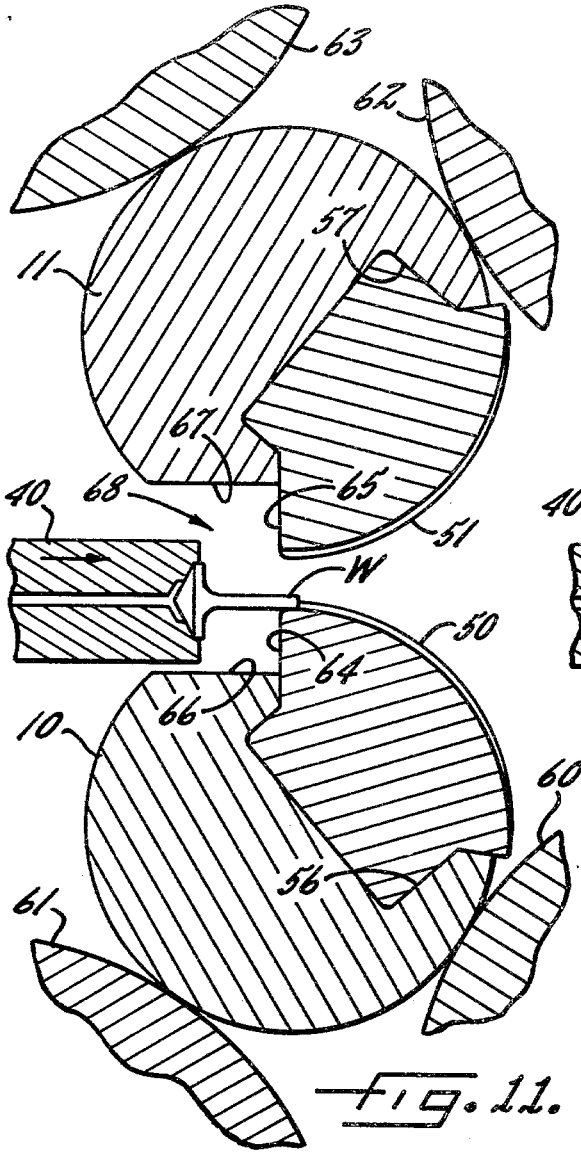
FIG. 11 is an enlarged vertical section taken through the forging dies of the two work rolls in the machine of FIGS. 1-4, showing fragments of the backup rolls, with the workpiece of FIG. 5 just entering the work station and the top work roll in its raised position.
Figure 12:
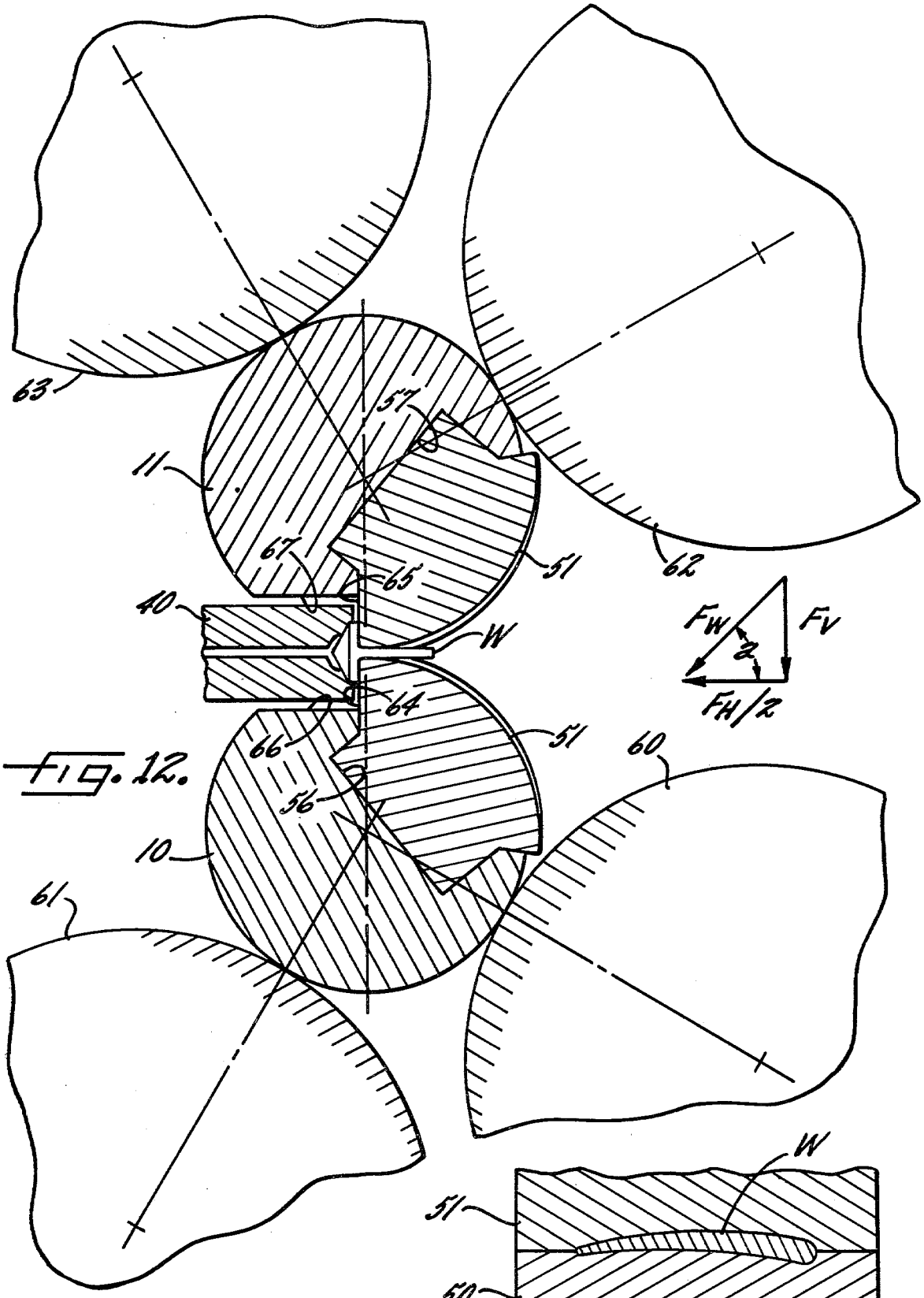
FIG. 12 is the same sectional view shown in FIG. 11, showing more of the backup rolls, with the top work roll lowered against the workpiece.
Figure 15:
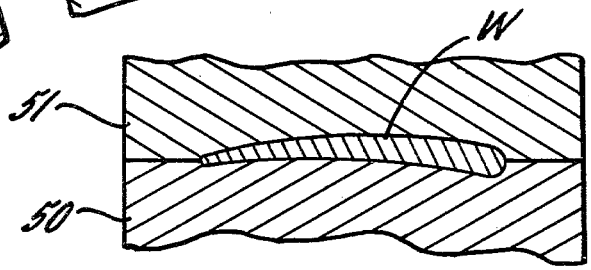
FIG. 15 is an enlarged section taken generally along line 15—15 in FIG. 14.

Before the roll forging is initiated, the leading ends of the two dies 50 and 51 are used to coin the base region of the blade 31. As can be seen most clearly in FIGS. 11 and 13, portions of the work rolls 10 and 11 are cut away adjacent the leading radial faces 64 and 65 of the respective forging dies, as at 66 and 67, to provide an access opening 68 for the workpiece W and the leading end of its holder 40. FIG. 11 shows the workpiece W and the holder 40 advancing through this opening 68, with the upper roll 11 still in its raised or retracted position. In FIG. 12, the workpiece W has been fully advanced against the dies 50 and 51, with the blade side of the head 30 abutting the radial faces 64 and 65 of the dies. With the workpiece in this advanced position, the top work roll 11 is lowered to squeeze the base region of the blade 31 between the leading ends of the two dies 50 and 51. Continued pressure applied to the top work roll 11 by the hydraulic cylinder 27 then effects the coining of this base region of the blade 31, including the corner regions where the head 30 merges with the blade 31.

During this coining operation, a high pressure is also maintained on the tool holder 40 by the cylinder 43 to firmly hold the workpiece against the radial faces 64 and 65 of the dies 50 and 51. This horizontal force is necessary because the coining of the illustrative workpiece W must not only thin and shape the cross section of the base region of the blade 31, but also reduce the radius of curvature of the corner region where the blade 31 merges with the head 30. To achieve this result, the working force must be applied to the workpiece at an angle of about 45° with respect to the horizontal plane of the workpiece.

A particularly desirable feature of the invention is that the two backup rolls for each work roll are positioned asymmetrically with respect to the plane of the workpiece, with the backup roll on the feed side of the work roll being located farther away from the plane of the workpiece than is the backup roll on the other side of the work roll. Thus, in the illustrative machine the backup rolls 60 and 62 are located closer to the horizontal plane of the workpiece than are the other two backup rolls 61 and 63, thereby providing firm backup for the forces exerted on the work rolls during the coining operation. These forces are the resultants of the vertical force $F_V$ applied by the hydraulic cylinder 27 and the horizontal force $F_H$ applied by the hydraulic cylinder 43.

Figure 13:
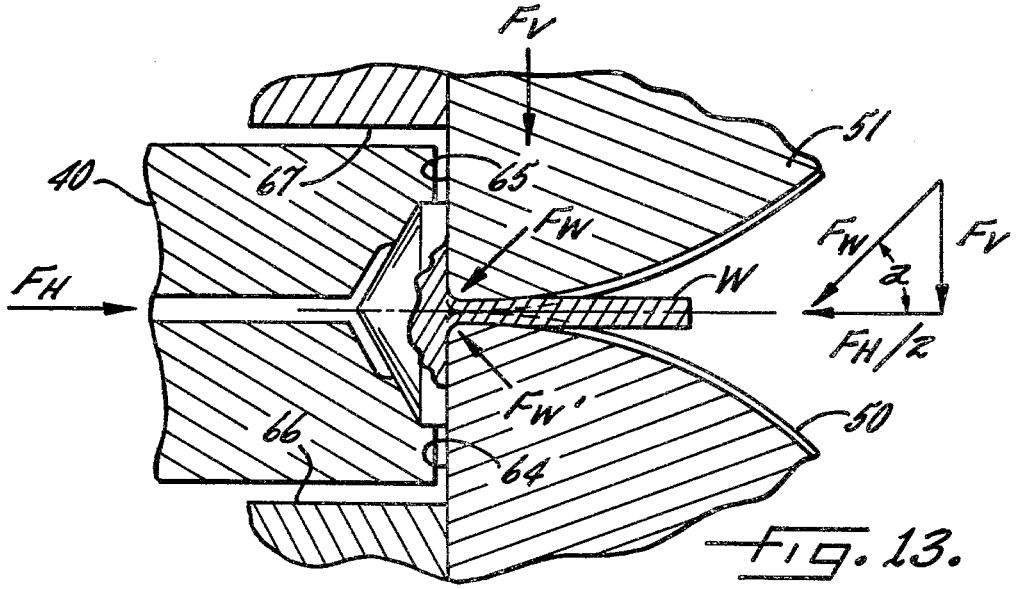
FIG. 13 is an enlarged sectional view of the central portion of the structure shown in FIG. 12, illustrating the coining of the base region of the workpiece.

As can be seen from the vector diagrams in FIGS. 12 and 13, the resultant working forces $F_W$ and $F_W'$ applied to the workpiece W during coining are applied at acute angles a and a' relative to the horizontal plane of the workpiece. The reaction of the workpiece to these working forces $F_W$ and $F_W'$ is effectively opposed by the backup rolls 60 and 62 due to the fact that these rolls are located closer to the horizontal plane of the workpiece than are the other two backup rolls 61 and 63.

During the rolling of the blade portion 31 of the workpiece W, only the vertical hydraulic cylinder 27 applies a working force to the work rolls 10 and 11. The vertical working force is applied mainly through the top backup roll 63, producing an equal and opposite reaction force from the bottom backup roll 61. Horizontal force components are supported by the backup rolls 62 and 64.

Thus, it can be seen that the asymmetrical arrangement of the two pairs of backup rolls 60, 61 and 62, 63, which engage the respective work rolls 10 and 11 at points located on opposite sides of the line passing through the centers of the two work rolls, provides effective backup support for the work rolls during both the coining operation and the rolling operation.

Figure 14:
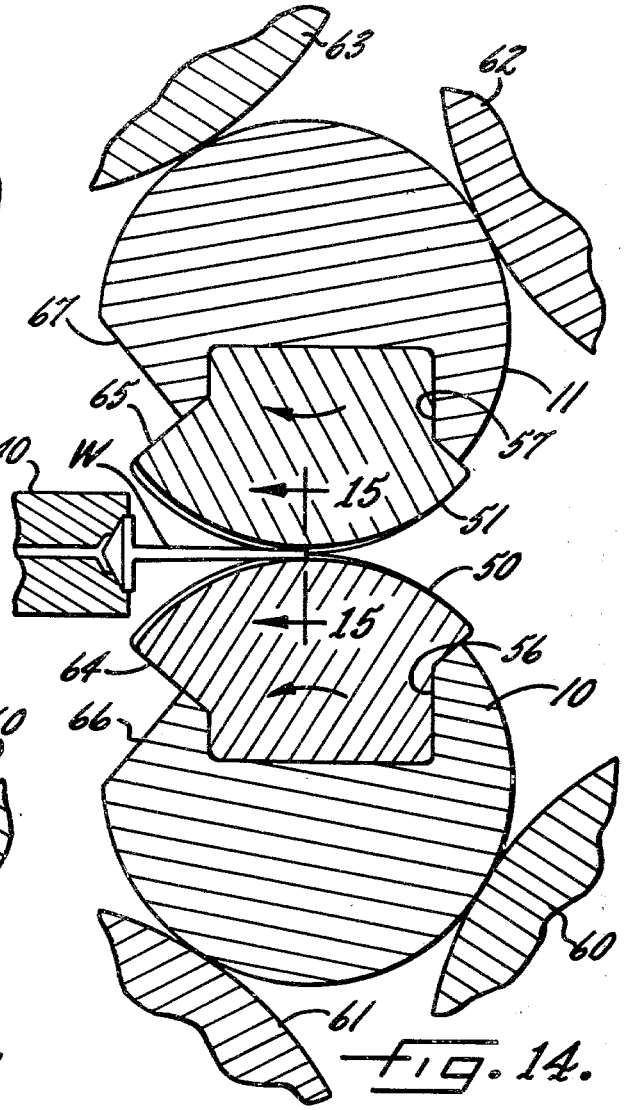
FIG. 14 is the same sectional view shown in FIG. 11 with the top work roll in its lowered position and with both work rolls rotated to a position near the end of the forging operation.

In accordance with a further aspect of the invention, the vertical and horizontal forces applied to the workpiece during the coining operation are maintained at a constant ratio with respect to each other, so that the resultant coining force applied to the workpiece W, as a result of the vertical and horizontal components $F_V$ and $F_H$, is always applied to the workpiece at a constant angle a. This is illustrated by the vector diagram in FIG. 14, in which the vectors $F_V$ and $F_V'$ represent the vertical forces on the workpiece due to the hydraulic cylinder 27, $F_H/2$ represents the horizontal force applied to each die by the hydraulic cylinder 43 via the workpiece, and $F_W$ and $F_W'$ represent the resultant forces applied to the workpiece as the vectoral sums of the vertical and horizontal forces $F_V$; $F_V'$ and $F_H$ ($F_V$ is always equal to $F_V'$, and $F_W$ is always equal to $F_W'$). $F_V$ and $F_H$ vary in magnitude during the coining operation, but always in direct proportion to each other, so that the angles a and a' of the resultant forces $F_W$ and $F_W'$ always remain constant, preferably at 45°. This is important to form a proper corner radius and is made possible by the firm backup support from the rolls 60 and 62 throughout the coining operation.

Upon completion of the coining operation, the horizontal pressure on the workpiece is removed by relieving the hydraulic pressure in the cylinder 43 so that the workpiece W can be retracted by the turning of the work rolls 10 and 11 during roll forging. The vertical forces $F_V$ and $F_V'$ on the workpiece are maintained, however, as the two work rolls 10 and 11 are rotated by the hydraulic actuators 12 and 13. The forging dies 50 and 51 are thus rolled along the top and bottom surfaces of the blade portion 31 of the workpiece W to forge the blade into the desired cross-sectional configuration. As the two dies 50 and 51 are turned in synchronism with each other, the workpiece W is gradually retracted from the two forging dies 50 and 51, with the blade portion 31 of the workpiece lengthening as its thickness is reduced by the forging dies and the high pressures applied thereto.

During the forging operation, the work rolls 10 and 11 are subjected to high separating forces due to the resistance of the workpiece W to the forging thereof. However, these high separating forces are rigidly opposed not only by the stiffness of the work rolls 10 and 11 and their support rails 52, 54 and 53, 55, but also by the backup rolls 60, 61 and 62, 63.

Figure 16:
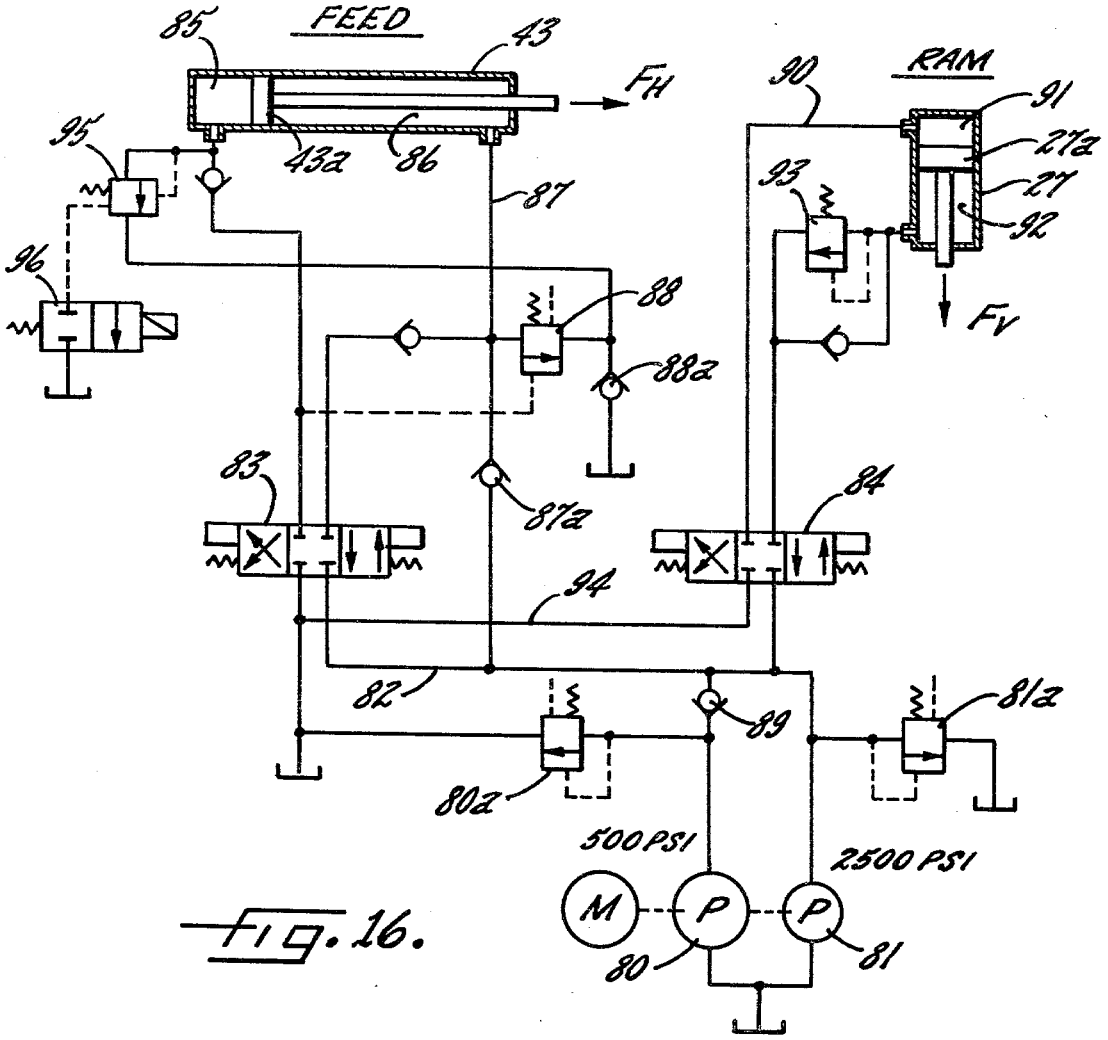
FIG. 16 is a schematic diagram of a hydraulic circuit for controlling the two hydraulic cylinders in the machine of FIGS. 1-15.

FIG. 16 is a schematic diagram of an exemplary hydraulic circuit for controlling the two hydraulic cylinders 27 and 43. Pressurized fluid is supplied to the system by two pumps 80 and 81, both of which have their discharge lines connected to a common supply line 82 leading to a pair of four-way valves 83 and 84. The discharge line of pump 80 is connected to a pressure-limiting valve **80*a* which sets a relatively low pressure limit, e.g., 500 psi, while the discharge line of pump 81 is connected to a pressure-limiting valve 81*a*** which sets a relatively high pressure limit, e.g., 2500 psi.

To initiate the feeding of a workpiece to the work rolls, the valve 83 is moved to its cross flow position (i.e., to the right as viewed in FIG. 16) to deliver fluid at a relatively low pressure (e.g., 500 psi) to compartment 85 on the front side of the piston 43*a*. This advances the piston 43*a* and the workpiece holder 40 attached thereto, with oil from compartment 86 on the back side of the piston being fed back through line 87 and check valve 87*a* to the supply line 82 to provide a regenerative action.

When the workpiece reaches its home position against the dies 50 and 51, the pressure in the supply line 82 increases due to the increased resistance against advancing movement of the piston 43*a*. This increased pressure in the line 82 opens a relief valve 88 to connect the compartment 86 to sump via check valve 88*a*.

At the same time the pressure increase in line 82 opens the relief valve 88, it also actuates a pressure responsive electrical switch (not shown) that moves the four-way valve 84 to its cross flow position (i.e., to the right as viewed in FIG. 16). This supplies fluid from the supply line 82 through line 90 to compartment 91 on the front side of the piston 27*a* in cylinder 27, thereby lowering the top work roll 11. Fluid discharged from compartment 92 of the cylinder 27 passes through a valve 93 (opened by the pressure increase in compartment 92) and valve 84 and on to sump via line 94. When the ram motion stops due to contact of the work rolls, pressure in line 82 and compartments 85 and 91 increases and also closes a check valve 89 to block off the 500 psi limit valve 80*a* from the supply line 82. Thus, the high pressure pump 81 and its relief valve 81*a* take over, supplying fluid to the line 82 and compartment 85 of cylinder 43 and compartment 91 of cylinder 27 at 2500 psi, and without the regenerative action (because valve 88 remains open) to increase the action force. This high pressure is maintained on the pistons 27*a* and 43*a*, and therefore the workpiece W, throughout the coining of the workpiece. This provides control of the ratio of the horizontal force referred to above as "$F_H$" and the vertical force referred to above as "$F_V$". The high pressure is maintained on pistons 27*a* and 43*a* for a predetermined time interval, at the end of which valve 83 is switched to its neutral position to remove the high horizontal force $F_H$ from the workpiece. With the valve 83 in this neutral position, the cylinder 43 urges the workpiece toward its advanced position under relatively light pressure that can be overcome by the retracting force exerted on the workpiece by the work rolls 10 and 11 as they are turned to forge the workpiece. During this retracting movement of the workpiece and the piston 43*a*, fluid discharged from compartment 85 passes through a valve 95 (which opened by a solenoid valve 96) and on to sump via check valve 88*a*.

To carry out the roll forging operation, the hydraulic actuators 12 and 13 are energized to turn the work rolls 10 and 11 while maintaining the high vertical force $F_V$ via the 2500 psi pressure on piston 27*a*. When the rolling operation is completed, as sensed by a limit switch (not shown), valve 84 is switched to its parallel flow position (i.e., to the left as viewed in FIG. 16) to connect the compartment 91 of cylinder 27 to sump and thereby remove the vertical force $F_V$ from the workpiece. Pressurized fluid from the supply line 82 then enters compartment 92 to retract the piston 27*a* and thereby raise the top work roll 11 to permit withdrawal of the workpiece. Actual withdrawal of the workpiece is effected by closing the relief valve 88 and switching valve 83 to the parallel flow position (i.e., to the left as viewed in FIG. 16) so that pressurized fluid from the supply line 82 enters the compartment 86 to retract the piston 43*a* and with it the workpiece holder 40 and workpiece W.

It can be seen from the foregoing detailed description, this invention provides a roll forging system which is capable of producing articles with a high degree of accuracy in the final dimensions in spite of relatively large changes in thickness and shape along the length of the articles. This system is capable of repetitively producing large numbers of such articles with a high degree of uniformity and reliability. The preferred embodiment of the roll forging system is also capable of coining selected regions of the workpiece. Whether the system is used for roll forging alone or both roll forging and coining, the arrangement of support rails on the work rolls and/or the asymmetrical arrangement of the backup rolls provides excellent rigidity while minimizing the stiffness requirements in the main frame which carries the work rolls, thereby minimizing the cost of the machine and improving its efficiency. As a further feature, the forging dies are readily accessible for servicing and replacement.

We claim as our invention:

1. In a roll forging machine comprising a pair of opposed work rolls carrying cooperating dies for forging a workpiece positioned between the two rolls, drive means for rotating said work rolls, a supporting frame for said work rolls, a pair of support rails fixedly mounted on each work roll on opposite sides of the die thereon and aligned with each other and with said die in the longitudinal direction along the surface of the work roll, said support rails on the two work rolls being aligned with each other so that the two pairs of rails ride on each other when the work rolls are urged toward each other and turned to forge a workpiece therebetween, means for urging said work rolls toward each other with a force substantially greater than the force required to forge the workpiece so that the work rolls are prestressed by the pressure of said support rails on each other, said support rails being substantially wider than said dies in the direction of the axes of said work rolls so that said work rolls with said support rails thereon have a spring constant substantially greater than the spring constant of said supporting frame for the work rolls.

2. A roll forging machine as set forth in claim 1 wherein said dies and support rails occupy only preselected segments of the circumferences of said work rolls, and which includes two pairs of backup rolls bearing against said work rolls along substantially the entire lengths thereof on those segments of the circumferences not occupied by said dies and support rails, one pair of said backup rolls bearing against each of said work rolls, the diameters said work rolls being substantially smaller than the diameters of said backup rolls.

3. A roll forging machine as set forth in claim 2 wherein each work roll and the pair of backup rolls bearing thereagainst are mounted in a common integral support.

4. A roll forging machine as set forth in claim 1 wherein said work rolls are recessed to receive said dies and support rails, at least the base portions of the opposed surfaces of said dies and support rails are flared outwardly toward each other, and a plurality of clamping means are secured to the bottoms of said recesses, said clamping means bearing down against said flared surfaces to clamp said dies and support rails to said work rolls.

5. A roll forming machine as set forth in claim 1 wherein said drive means for rotating said work rolls are mounted at the ends of said rolls so that the nip of said work rolls remains accessible for replacement of said dies.

6. A roll forging machine comprising a pair of opposed work rolls carrying cooperating dies for forging a workpiece positioned between the two rolls, drive means for rotating said work rolls, a supporting frame for said work rolls, two pairs of opposed support rails fixedly mounted on said work rolls on opposite sides of said dies to provide said work rolls with a spring constant substantially greater than the spring constant of said supporting frame, and means for urging said work rolls together with a force substantially greater than the force required to forge the workpiece, whereby said opposed support rails are pressed together to prestress said work rolls.

7. In a roll forging machine comprising a pair of opposed work rolls carrying cooperating dies for forging a workpiece positioned between the two rolls, drive means for rotating said work rolls, and means for urging said work rolls toward each other while the rolls are turned to forge a workpiece, the improvement comprising means for urging said workpiece toward said work rolls from one side thereof at the same time that said rolls are urged toward each other with said workpiece therebetween, and two pairs of backup rolls bearing against said work rolls with one pair of said backup rolls bearing against each work roll on opposite sides of a line passing through the centers of the two work rolls, the two backup rolls for each work roll being positioned asymmetrically with request to the plane of the workpiece, with the backup roll on the feed side of the work roll being located farther away from the plane of the workpiece than is the other backup roll.

8. A roll forging machine as set forth in claim 7 wherein said dies occupy only preselected segments of the circumferences of said work rolls, and said backup rolls engage those segments of said circumferences not occupied by said dies.

9. A roll forging machine as set forth in claim 7 wherein each work roll and its pair of backup rolls are mounted in a common integral support.

10. In a roll forging machine comprising a pair of opposed work rolls carrying cooperating dies for forging a workpiece positioned between the two rolls, said dies forming a pair of radial surfaces for engaging corresponding shoulders on a workpiece inserted between said work rolls, drive means for rotating said work rolls, variable pressure applying means for urging said work rolls toward each other while the rolls are turned to forge a workpiece, and means for urging the shoulders of said workpiece against said radial surfaces of said dies with a pressure that varies in direct proportion to variations in the pressure at which said work rolls are urged toward each other.

11. A roll forging machine as set forth in claim 10 wherein said means for urging said work rolls toward each other comprises a first hydraulic cylinder, said means for urging the shoulders of said workpiece against the radial surfaces of said dies comprises a second hydraulic cylinder, and said first and second hydraulic cylinders are supplied with hydraulic fluid from a common source at a common pressure so that the ratio of pressures applied by the two cylinders remains constant.

* * * * *